US008903258B2

(12) United States Patent
Hayami

(10) Patent No.: US 8,903,258 B2
(45) Date of Patent: Dec. 2, 2014

(54) IMAGE FORMING APPARATUS AND METHOD OF CONTROLLING TRANSFER CURRENT IN THE IMAGE FORMING APPARATUS

(75) Inventor: Toshiki Hayami, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 227 days.

(21) Appl. No.: 13/534,089

(22) Filed: Jun. 27, 2012

(65) Prior Publication Data

US 2013/0004191 A1 Jan. 3, 2013

(30) Foreign Application Priority Data

Jun. 29, 2011 (JP) ..... 2011-143651

(51) Int. Cl.
*G03G 15/16* (2006.01)
*G03G 15/14* (2006.01)

(52) U.S. Cl.
CPC .... *G03G 15/1675* (2013.01); *G03G 2215/0135* (2013.01)
USPC ..... 399/66; 399/315

(58) Field of Classification Search
USPC ..... 399/66, 315, 314, 297, 306, 310
See application file for complete search history.

(56) References Cited

U.S. PATENT DOCUMENTS

2009/0067864 A1* 3/2009 Shirafuji ..... 399/66

FOREIGN PATENT DOCUMENTS

| | | | | |
|---|---|---|---|---|
| JP | 8-114989 A | | 5/1996 | |
| JP | 2000039782 A | * | 2/2000 | ..... G03G 15/16 |
| JP | 2000-66536 A | | 3/2000 | |

* cited by examiner

*Primary Examiner* — Billy Lactaoen
(74) *Attorney, Agent, or Firm* — Cantor Colburn LLP

(57) ABSTRACT

An image forming apparatus includes: a transfer member, a controller, a discharge electrode, a detector, and a storage section. The controller, based on an amount of change between parameter value detected by the detector after transfer by the transfer member and parameter value stored in the storage section, determines voltage necessary for the discharge electrode to take the same amount of current as an increase in transfer current of the transfer member from previously determined transfer current and applies the determined voltage to the discharge electrode.

10 Claims, 14 Drawing Sheets

IMAGE FORMING APPARATUS AND METHOD OF CONTROLLING TRANSFER CURRENT IN THE IMAGE FORMING APPARATUS

BACKGROUND OF THE INVENTION

1. Field of the Invention

The present invention relates to an image forming apparatus and a method of controlling transfer current.

2. Description of Related Art

In a conventional electrophotographic image forming apparatus, a transfer material or an intermediate transfer body passes between a photoreceptor and a transfer member. During the passage, a toner image on the photoreceptor is transferred to the transfer material or intermediate transfer body by a transfer bias applied to the transfer member. The transfer bias is generally controlled under constant voltage control or constant current control.

The transfer member is generally composed of a transfer roller. The transfer roller is made of a material having an electric resistance (hereinafter, referred to as a resistance) highly dependent on the environment. Various techniques to address environmental change have been proposed.

For example, Patent Literature 1 (Japanese Patent Application Laid-open Publication No. 08-114989) describes a technique to perform constant current control and constant voltage control according to whether the resistance value of the contact transfer member measured by a resistance measuring means is higher than a predetermined reference value. Moreover, Patent Literature 1 describes a static charge eliminator which is configured to be switched to a DC bias applied mode at low temperature and low humidity, a grounding mode at room temperature and room humidity; and a floating mode at high temperature and high humidity.

Patent Literature 2 (Japanese Patent application Laid-open Publication No. 2000-66536) describes a technique of holding plural levels of potential applied to a static charge eliminating member and switching the levels of potential applied to the static charge eliminating member according to voltage detected with the constant current bias applied to the transfer roller.

By the way, inflowing current varies on the resistance of the transfer member. In the case where the transfer member is under constant voltage control, therefore, if the transfer member continues to be subjected to constant voltage, changing resistance of the transfer member changes transfer properties, thus changing the image density. Accordingly, it is necessary to reset optimal applied voltage at proper intervals. As the method of controlling the same, ATVC (active transfer voltage control) is well known. The ATVC determines voltage to be applied to the transfer member so that the transfer current flowing through the transfer member be a previously determined optimal transfer current.

However, if continuous printing is performed by a print job for a lot of sheets, the resistance of the transfer member decreases to cause excess current, thus degrading the transfer properties (see FIGS. 13A and 13B). To solve this problem, the ATVC may be performed for each certain number of prints or each certain change in temperature. However, the ATVC takes long time, thus causing reduction in productivity.

The techniques of the aforementioned Patent Literatures 1 and 2 cannot cope with the change in density caused by excess current due to changing resistance of the transfer member under constant voltage control.

SUMMARY OF THE INVENTION

An object of the present invention is to, in the case where the transfer member is under constant voltage control, prevent change in transfer properties due to the reduction in resistance of the transfer member without reducing the productivity.

According to a first aspect of the present invention, there is provided an image forming apparatus including: a transfer member to transfer a toner image formed on a photoreceptor to an intermediate transfer body or a transfer material; a controller to determine voltage to be applied to the transfer member so that transfer current of the transfer member has a previously determined value and to perform constant voltage control so that the voltage to be applied to the transfer member becomes the determined voltage; a discharge electrode provided near a transfer nip portion of the transfer member to take a part of the transfer current flowing through the transfer member according to the applied voltage; a detector to detect a parameter value of a predetermined parameter by which the transfer current of the transfer member that changes by continuous operation of the constant voltage control can be specified; and a storage section to store the parameter value detected by the detector immediately after the voltage to be applied to the transfer member is determined, wherein based on an amount of change between the parameter value detected by the detector after transfer by the transfer member and the parameter value stored in the storage section, the controller determines voltage necessary for the discharge electrode to take the same amount of current as an increase in transfer current of the transfer member from the previously determined transfer current and applies the determined voltage to the discharge electrode.

Preferably, the controller does not apply voltage to the discharge electrode if the amount of change between the parameter value detected by the detector after the transfer and the parameter value stored in the storage section does not exceed a previously determined value.

Preferably, the predetermined parameter includes transfer current of the transfer member.

Preferably, the predetermined parameter includes electric resistance of the transfer member.

Preferably, the detector includes a density sensor for reading an image patch for density measurement which is formed on the photoreceptor and transferred to the intermediate transfer body, and the predetermined parameter includes an output of the density sensor.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

With reference to the drawings, a description is given of the configuration and operation of an image forming apparatus of an embodiment of the present invention in detail. The embodiment of the present invention describes about a color image forming apparatus 1 as an example. However, the present invention is not limited to this example and can be implemented by a monochromic image forming apparatus, for example.

[Configuration of Image Forming Apparatus 1]

Figure 1:
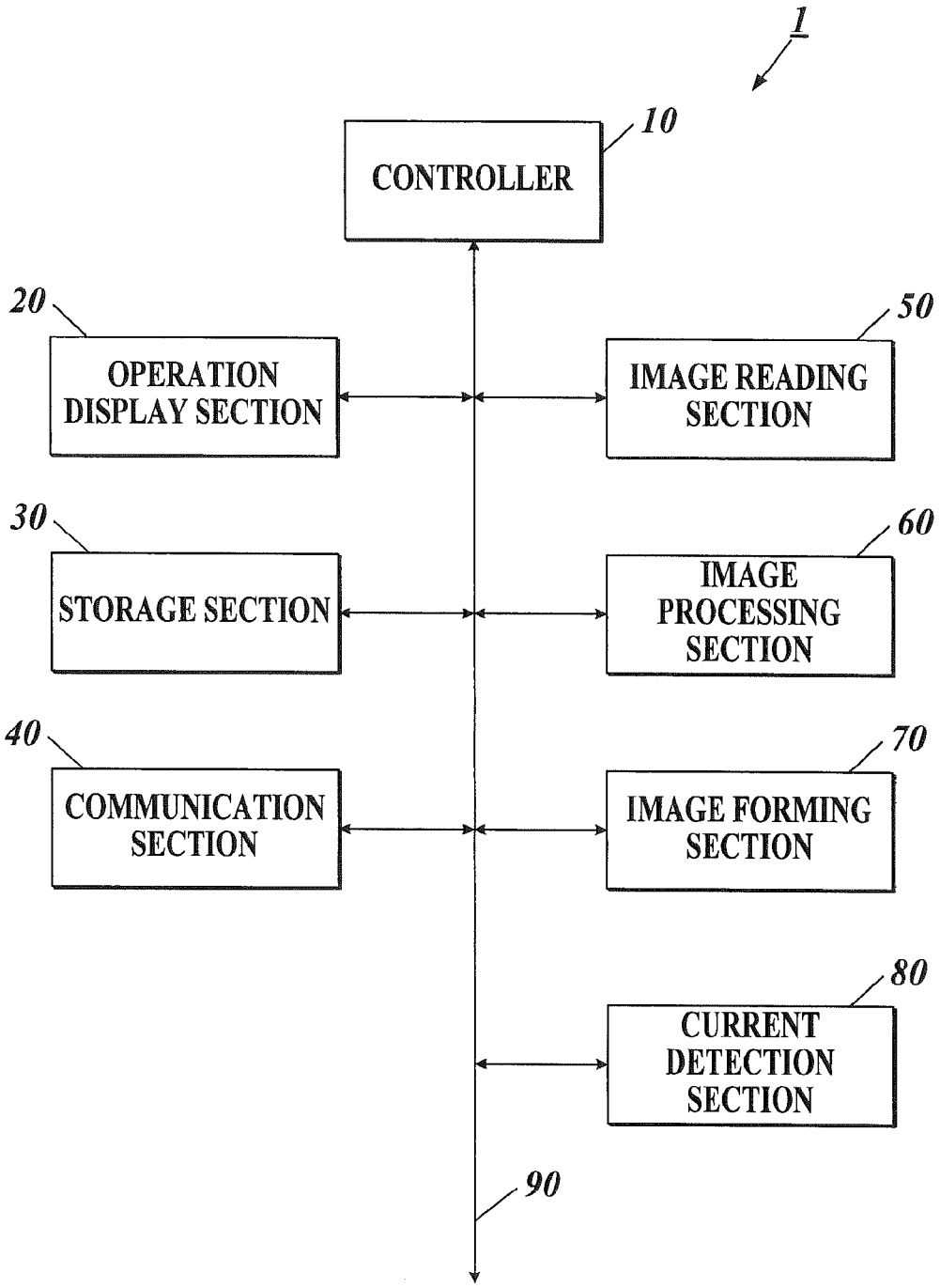
FIG. 1 is a block diagram showing a functional configuration of an image forming apparatus.
Figure 2:
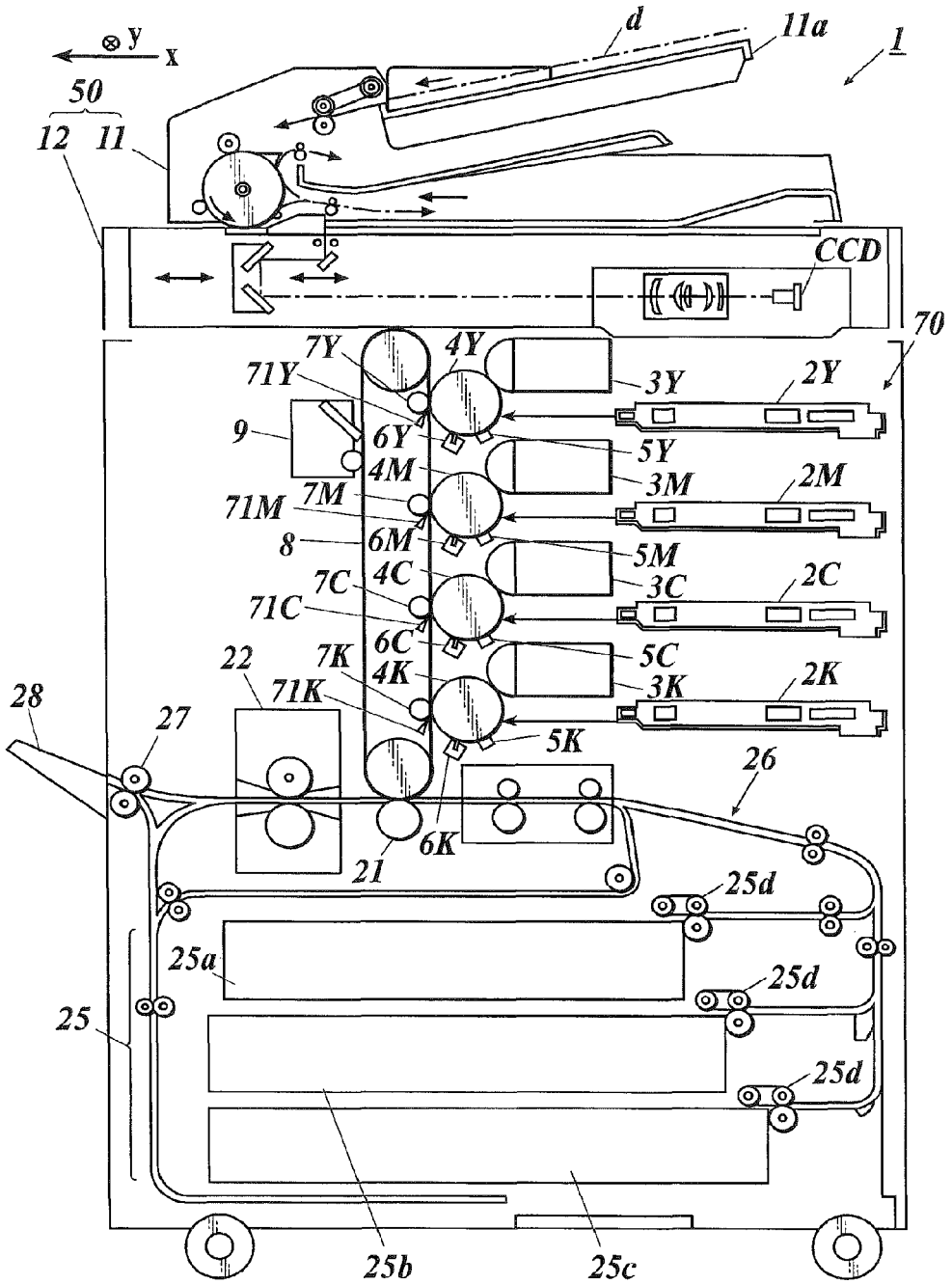
FIG. 2 is a view showing a schematic configuration example of the image forming apparatus.

FIG. 1 shows a functional block diagram of the image forming apparatus 1. FIG. 2 shows a schematic configuration within the image forming apparatus 1.

As shown in FIG. 1, the image forming apparatus 1 includes a controller 10, an operation display section 20, a storage section 30, a communication section 40, an image reading section 50, an image processing section 60, an image forming section 70, a current detection section 80, and the like, which are connected to each other through a bus 90.

The controller 10 is composed of a CPU (central processing unit), a RAM (random access memory), and the like. The CPU of the controller 10 loads to the RAM, a system program and various processing programs stored in the storage section 30 and centrally controls each section of the image forming apparatus 1 according to the loaded programs.

For example, in cooperation with a program stored in the storage section 30, the controller 10 reads an image from a document placed on a document tray 11*a* through the image reading section 50; executes a job based on the read image of the document and job information including image forming conditions inputted from the operation display section 20; and forms an image on each sheet (transfer material) for output. Moreover, in cooperation with a program stored in the storage section 30, the controller 10 receives image data transmitted from an external device or the like and the job information including the image forming conditions for data of each image through the communication section 40; executes a job based on the received job information; and forms an image on each sheet to output the sheet.

In cooperation with a program stored in the storage section 30, the controller 10 executes a later-described applied voltage control process.

The operation display section 20 is composed of an LCD (liquid crystal display) and the like. The operation display section 20 displays various operation buttons, the state of the image forming apparatus 1, operating conditions of each function, and the like on the display screen according to an instruction of a display signal inputted from the controller 10. The display screen of the LCD is covered with a pressure-sensitive (resistive-type) touch panel including transparent electrodes arranged in a grid. The operation display section 20 detects X- and Y-coordinates of the operation point pressed by a finger, a touch pen, or the like as a voltage value and outputs a signal of the detected position to the controller 10 as an operation signal. Moreover, the operation display section 20 includes various operation buttons such as number buttons and a start button and outputs an operation signal generated based on a button operation to the controller 10.

The storage section 30 is composed of a non-volatile memory and the like and stores a system program executable by the image forming apparatus 1, various processing programs executable in the system program, data used at execution of the various processing programs, data of processing results calculated by the controller 10, and the like.

The storage section 30 stores applied voltage control curves 31Y, 31M, 31C, and 31K (see FIG. 10) used in the later-described applied voltage control process, for example.

The communication section 40 is composed of a modem, a LAN adaptor, a router, and the like. The communication section 40 controls communication with external devices such as a PC (personal computer) connected to a communication network such as a LAN (local area network) or a WAN (wide area network) and performs reception of the job information and the like.

The image reading section 50 includes an automatic document-feeding unit 11 called an ADF (auto-document feeder) and a reading unit 12 as shown in FIG. 2. The automatic document-feeding unit 11 conveys a document d placed on the document tray 11*a* onto a contact grass where the document d is to be read. The reading unit 12 projects light onto the document d placed on the contact grass and reads the reflected light with a CCD (charge coupled device) for photoelectric conversion. The reading unit 12 thus takes an image signal of the document d and outputs the same to the image processing section 60.

The image processing section 60 performs various types of image processing, such as A/D conversion, shading correction, and image compression, for the image (analogue image signal) outputted by the image reading section 50 and then separates the image by colors of Y (yellow), M (magenta), C (cyan), and K (black). The image processing section 60 then outputs the image data of each color to the image forming section 70 as digital image data.

The image forming section 70 forms an image on each sheet with an electrophotographic method based on the inputted image data. As shown in FIG. 2, the image forming section 70 includes: exposure units 2Y, 2M, 2C, and 2K; development units 3Y, 3M, 3C, and 3K; photoreceptor drums 4Y, 4M, 4C, and 4K; charge units 5Y, 5M, 5C, and 5K; cleaning units 6Y, 6M, 6C, and 6K; primary transfer rollers 7Y, 7M, 7C, and 7K as transfer members; an intermediate transfer belt 8 as an image transfer body; a belt cleaning unit 9; a secondary transfer roller assembly 21; a fixing unit 22; a paper feeder 25; and a conveyance section 26 including an exit roller assembly 27.

Each of the exposure units 2Y, 2M, 2C, and 2K includes a laser beam source, a polygon mirror, plural lenses, and the like. The exposure units 2Y, 2M, 2C, and 2K scan and expose the surfaces of the photoreceptor drums 4Y, 4M, 4C, and 4K with laser beams based on the image data transmitted from the image processing section 60, respectively. By the scanning exposure with the laser beams, latent images are formed, or images are written at image forming positions of the photoreceptor drums 4Y, 4M, 4C, and 4K charged by the charge units 5Y, 5M, 5C, and 5K, respectively. The image forming positions of the photoreceptor drums 4Y, 4M, 4C, and 4K are positions on the photoreceptor drums 4Y, 4M, 4C, and 4K where the latent images are to be formed.

The latent images formed on the photoreceptor drums 4Y, 4M, 4C, and 4K are developed by the respective development units 3Y, 3M, 3C, and 3K to be visualized, so that toner images are formed on the respective photoreceptor drums 4Y, 4M, 4C, 4K.

The toner images formed and supported on the photoreceptor drums 4Y, 4M, 4C, and 4K are sequentially transferred to a predetermined position on the intermediate transfer belt 8 by the primary transfer rollers 7Y, 7M, 7C, and 7K to each of which constant voltage is applied by a not-shown power supply. Primary transfer is thus performed. Residual toner on the surfaces of the photoreceptor drums 4Y, 4M, 4C, and 4K which have already finished transfer of the toner images are removed by the respective cleaning units 6Y, 6M, 6C, and 6K.

The intermediate transfer belt 8 is a semiconductor endless belt which is laid over plural rollers and is rotatably supported. The intermediate transfer belt 8 is driven to rotate with rotation of the rollers.

The intermediate transfer belt 8 comes into pressure contact with the photoreceptor drums 4Y, 4M, 4C, and 4K by the primary transfer rollers 7Y, 7M, 7C, and 7K, respectively. Transfer currents individually flow through the primary transfer rollers 7Y, 7M, 7C, and 7K according to the voltages applied to the same. The toner images developed on the surfaces of the photoreceptor drums 4Y, 4M, 4C, and 4K are sequentially transferred (primary-transferred) to the intermediate transfer belt 8 by the primary transfer rollers 7Y, 7M, 7C, and 7K, respectively.

On the other hand, in the paper feeder 25, sheets of the type specified by the controller 10 are fed and conveyed by the conveyance section 26 to a transfer position where each sheet is subjected to transfer by the secondary transfer roller assembly 21. At the transfer position, the roller pair of the transfer roller assembly 21 sandwiches and conveys each sheet to transfer (secondary-transfer) the color toner image onto the sheet. After transfer, the sheet is conveyed to the fixing unit 22 for heat fixing of the toner image transferred to the same. The sheet is delivered by the exit roller assembly 27 to an exit tray 28. The residual tonner on the intermediate transfer belt 8 is removed by the belt cleaning unit 9.

The current detection section 80 detects the transfer currents flowing through the primary transfer rollers 7Y, 7M, 7C, and 7K and outputs the detected current values to the CPU of the controller 10. In this embodiment, the current detection section 80 is provided on a control substrate of the controller 10.

Herein, the primary transfer rollers 7Y, 7M, 7C, and 7K are composed of ion-conductive rollers, for example and have resistance highly dependent on environmental changes. Accordingly, if transfer is repeated under constant voltage control of the transfer bias to increase the temperature of the primary transfer rollers 7Y, 7M, 7C, and 7K themselves, the resistances of the primary transfer rollers 7Y, 7M, 7C, and 7K are reduced. The primary transfer rollers 7Y, 7M, 7C, and 7K therefore cause excess current, thus degrading the transfer properties (see FIGS. 13A and 13B). This problem can be solved by executing the ATVC for each certain number of prints (or each certain change in temperature/humidity). However, the ATVC takes long time (for example, about seven seconds), thus reducing the productivity.

Figure 3:
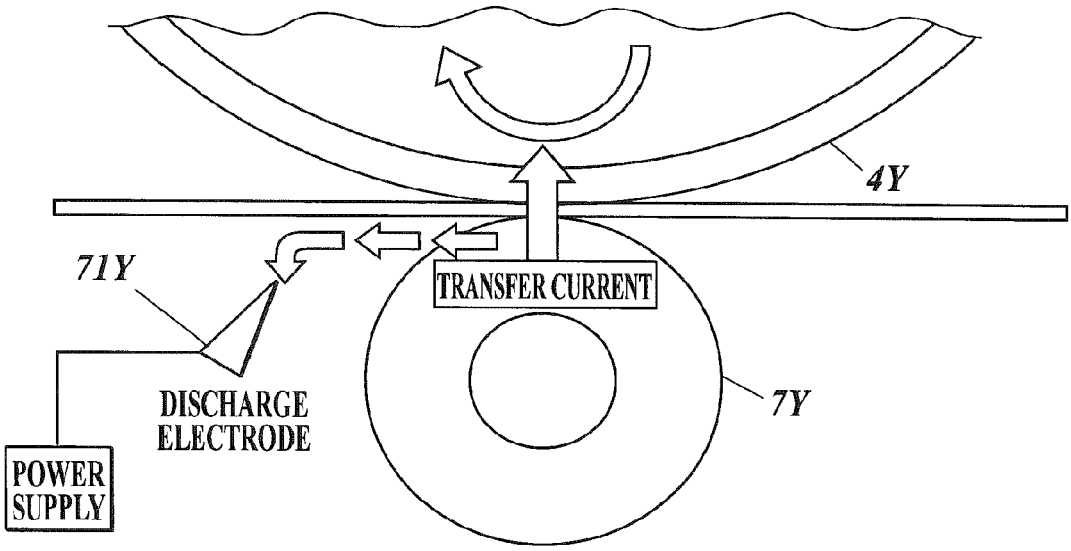
FIG. 3 is a view schematically showing a discharge electrode which takes a part of transfer current.
Figure 4:
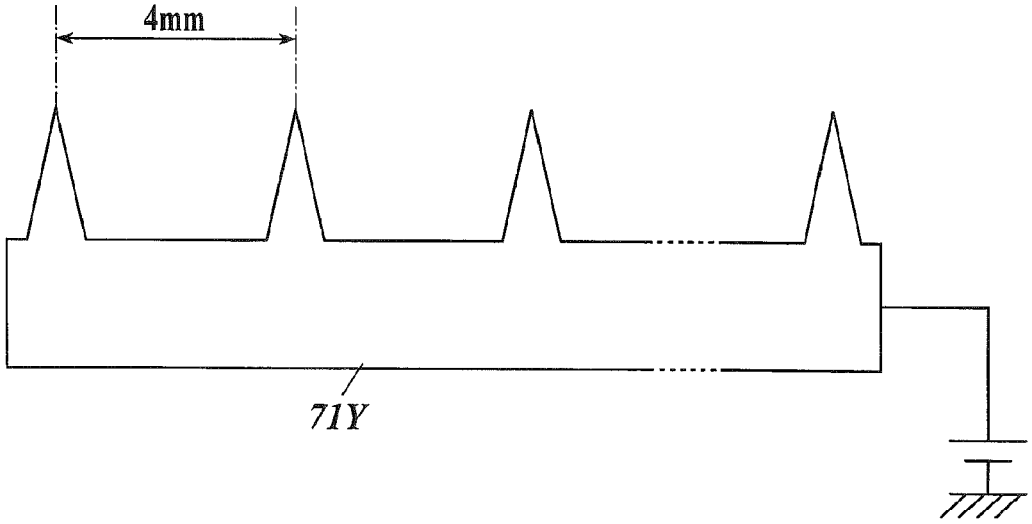
FIG. 4 is a view showing a configuration example of the discharge electrode.

Accordingly, discharge electrodes 71Y, 71M, 71C, and 71K are respectively provided near the primary transfer rollers 7Y, 7M, 7C, and 7K as shown in FIG. 3. Although only the discharge electrode 71Y is shown in FIG. 3 (also in FIG. 4) as an example, the same explanation can be applied to each electrode 71M, 71C, or 71K. The discharge electrodes 71Y, 71M, 71C, and 71K are subjected to such voltages that the discharge electrodes 71Y, 71M, 71C, and 71K emit minus charges to take the same amount of current as the increase (excess amount) in transfer current from the transfer current flowing immediately after the ATVC (including canceling the excess of transfer current), thus making control so that the transfer current used for transfer is kept constant. Each of the discharge electrodes 71Y, 71M, 71C, and 71K can include plural needle-like electrodes arranged at predetermined intervals as shown in FIG. 4, for example. If voltages are applied to the discharge electrodes 71Y, 71M, 71C, and 71K, the discharge electrodes 71Y, 71M, 71C, and 71K discharge from the tips thereof.

It can be experimentally and empirically determined how high voltage is to be applied to each of the discharge electrodes 71Y, 71M, 71C, and 71K. Herein, a description is given of an example of pre-experiments for determining voltages to be applied to the discharge electrodes using the discharge electrode 71Y as an example.

Figure 5:
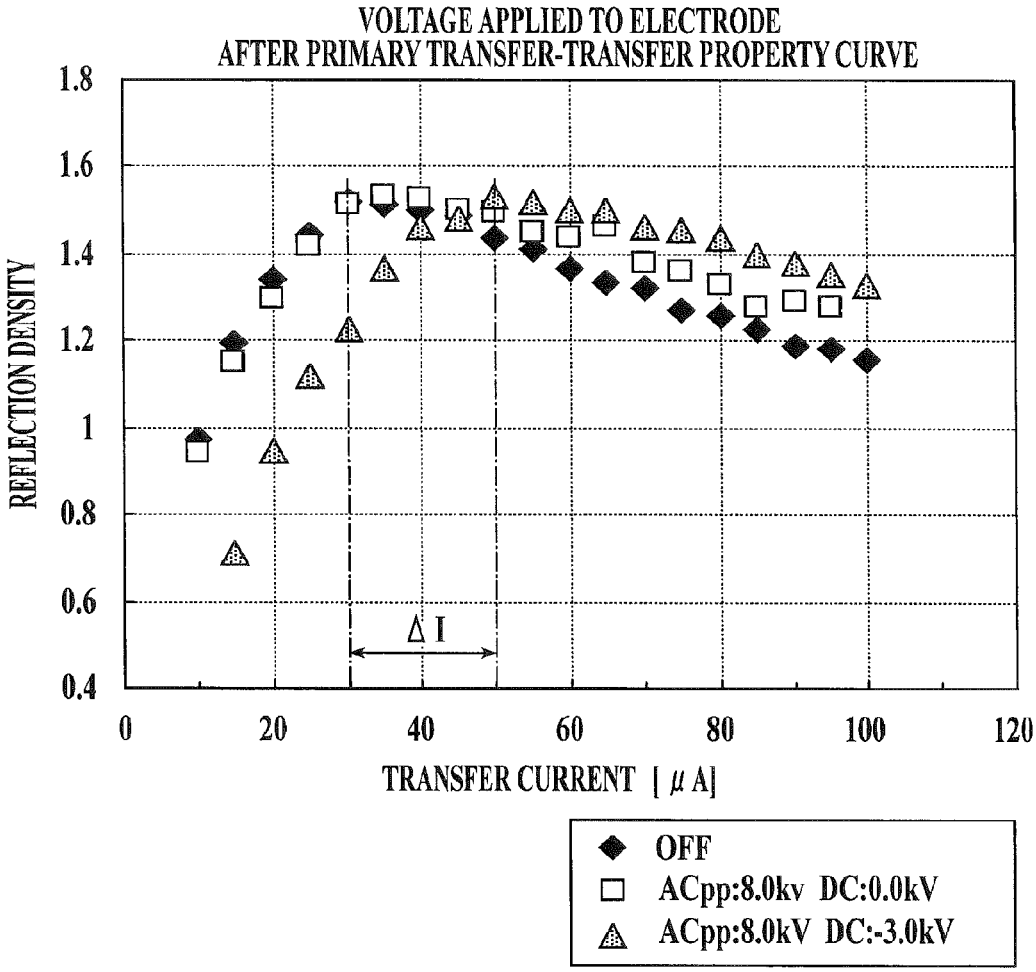
FIG. 5 is a diagram showing a relation between transfer current and reflection density when voltage applied to the discharge electrode changes.

FIG. 5 is a graph showing a relation between the transfer current and density (reflection density) when the voltage applied to the discharge electrode 71Y is changed. As shown in FIG. 5, when AC and DC voltages applied to the discharge electrode 71Y are both 0.0 V, the transfer current is 30 to 35 μA at the peak of the image density (optimal transfer current provided with the highest transfer properties). When AC and DC voltages applied to the discharge electrode 71Y are 8.0 kV and 0.0 V, respectively, the optimal transfer current is 35 to 40 μA at the peak of the image density. When AC and DC voltages applied to the discharge electrode 71Y are 8.0 kV and −3.0 kV, respectively, the optimal transfer current is 50 μA at the peak of the image density. In other words, when the AC voltage of 8.0 kV is applied to the discharge electrode 71Y, the optimal transfer current is shifted by about 5 μA. If the DC voltage of −3.0 kV is then superimposed on the AC voltage of 8.0 kV, the optimal transfer current is shifted by about 20 μA. This is considered to show that by discharge of the discharge electrode 71Y, the amount ΔI of current corresponding to the shift amount of the optimal transfer current flows into the discharge electrode 71Y from the transfer current actually flown to the primary transfer roller 7Y.

Figure 6:
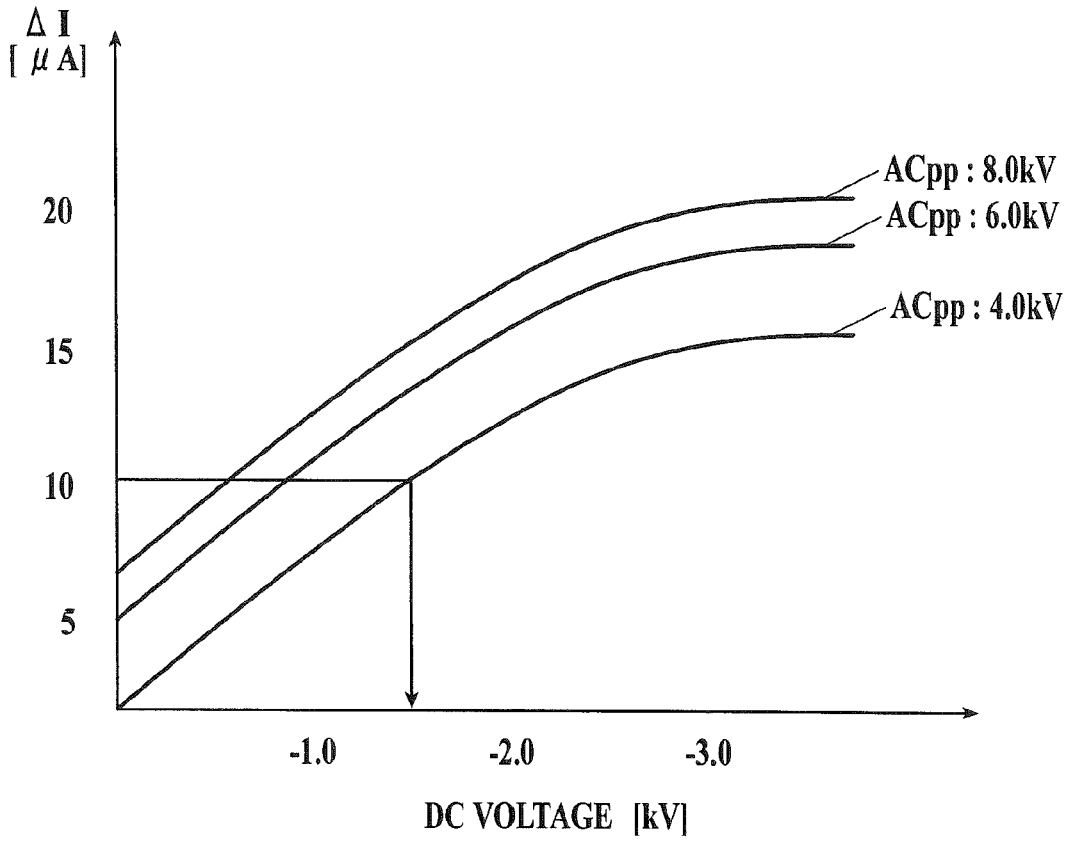
FIG. 6 is a diagram showing a relation between the voltage applied to the discharge electrode and an increase $\Delta I$ of the transfer current.

In such a manner, the relation between the voltage applied to the discharge electrode 71Y and the amount ΔI of current flown to the discharge electrode 71Y from the transfer current can be known as shown in FIG. 6 by changing the voltage to be applied to the discharge electrode 71Y and examining the difference in the optimal transfer current between when the discharge electrode 71Y is subjected and not subjected to the applied voltage by the pre-experiment. When the resistance of the primary transfer roller 7Y is reduced to increase the transfer current during the constant voltage control of the transfer bias, the transfer current actually used for transfer can be made constant by applying such a voltage to the discharge electrode 71Y that the amount ΔI of current corresponding to the increase in transfer current flows into the discharge electrode 71Y.

Figure 10:
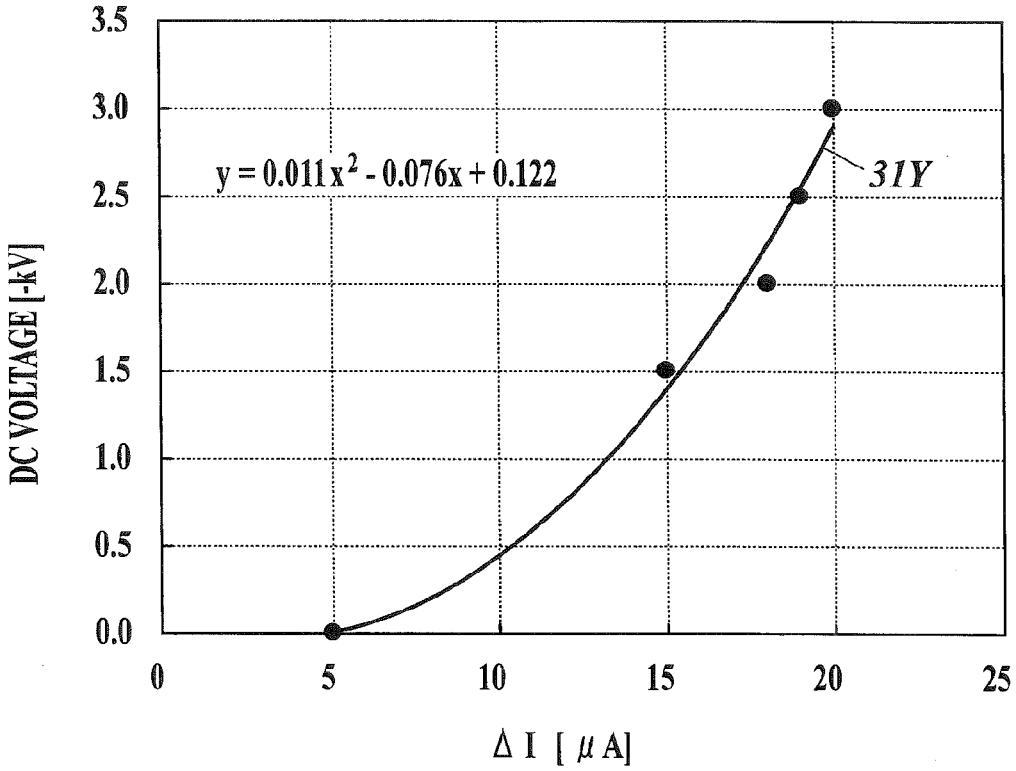
FIG. 10 is a diagram showing an applied voltage control curve used in the verification experiment.

Based on the relation between the voltage applied to the discharge electrode 71Y and the amount (ΔI) of current flown to the discharge electrode 71Y (the relation is obtained by the pre-experiment), the applied voltage control curve 31Y is generated with ΔI as an input and the voltage applied to the discharge electrode 71Y as an output and is stored in the storage section 30 (see FIG. 10). Although only the applied voltage control curve 31Y is shown in FIG. 10 as an example, the same explanation can be applied to each curve 31M, 31C, or 31K. In this embodiment, the AC voltage to be applied to the discharge electrode 71Y is previously determined by the pre-experiment to generate the applied voltage control curve 31Y from the relation between the amount of current flown to the discharge electrode 71Y and the DC voltage with the AC voltage being fixed. However, the applied voltage control curve is not limited to this. In a similar manner, pre-experiments are performed also for the discharge electrodes 71M, 71C, and 71K to generate the applied voltage control curves 31M, 31C, and 31K and store the same in the storage section 30.

In this embodiment, for the purpose of increasing the accuracy, the pre-experiments for determining voltages applied to the discharge electrodes 71Y, 71M, 71C, and 71K are respectively performed to generate the applied voltage control curves 31Y, 31M, 31C, and 31K based on the results of the experiments. However, if the primary transfer rollers have same characteristics, the aforementioned pre-experiment is performed for any one of the discharge electrodes 71Y, 71M, 71C, and 71K, and an applied voltage control curve generated based on the above pre-experiment may be shared to determine voltages applied to all the discharge electrodes.

[Operation of Image Forming Apparatus 1]

Next, a description is given of an operation of the image forming apparatus 1.

Figure 7:
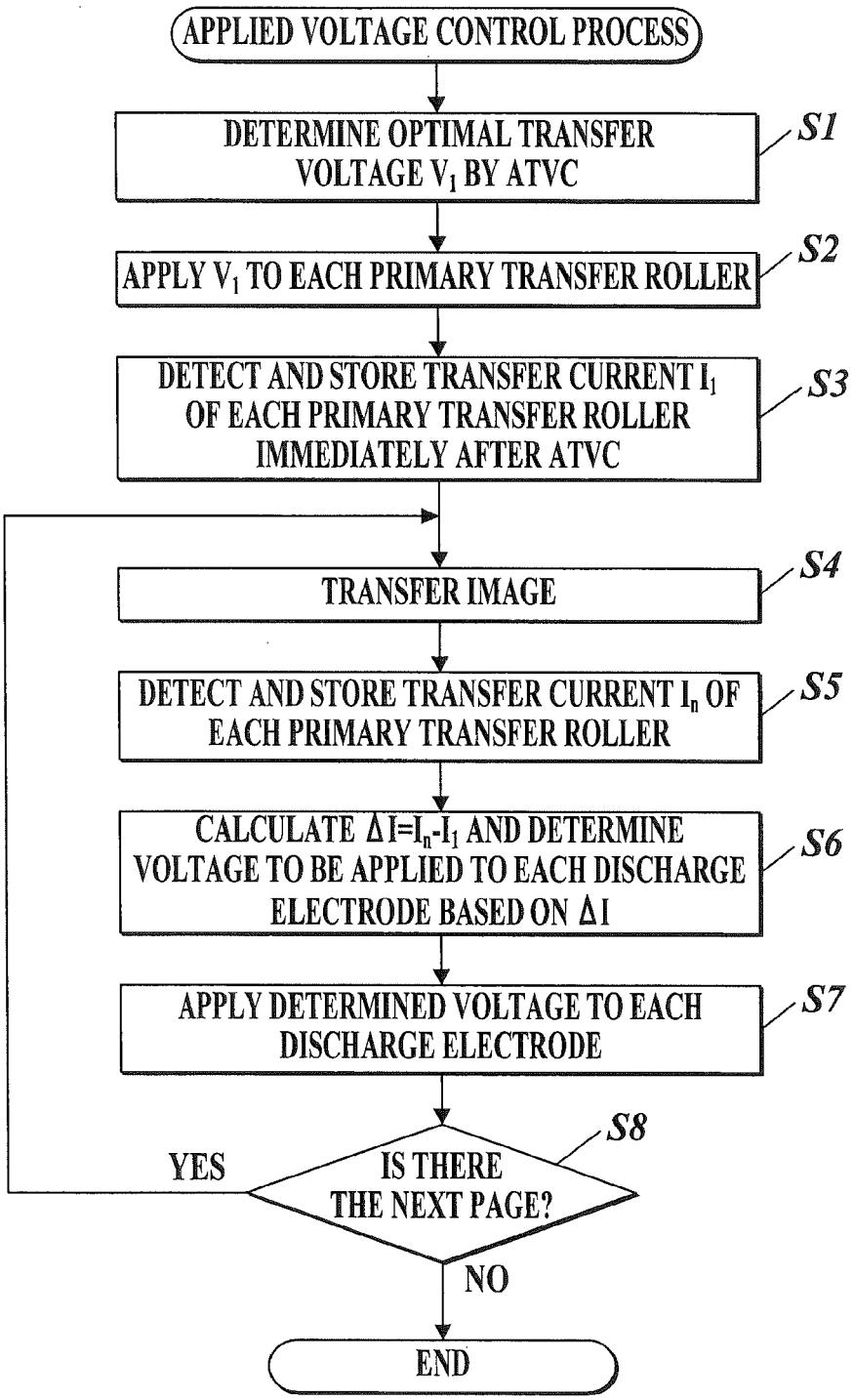
FIG. 7 is a flowchart showing an applied voltage control process executed by a controller of FIG. 1.

FIG. 7 shows a flowchart of the applied voltage control process executed by the controller 10. The applied voltage control process is executed in cooperation of the controller 10 and a program stored in the storage section 30 when the operation display section 20 or communication section 40 receives an instruction to execute a job.

At first, the ATVC is executed to determine an optimal transfer voltage $V_1$ (step S1). In the ATVC, first, voltages to be applied to the primary transfer rollers 7Y, 7M, 7C, and 7K are controlled to detect such a voltage $V_0$ that current flowing through each primary transfer roller 7Y, 7M, 7C, and 7K (transfer current) becomes a predetermined value. Subsequently, based on the detected voltage $V_0$, the optimal transfer voltage $V_1$ for each of the primary transfer rollers 7Y, 7M, 7C, and 7K is determined. Each optimal transfer voltage $V_1$ is determined using an expression of $A \times V_0 + B$ (A and B are previously determined constants), for example. The optimal transfer voltages $V_1$ are voltages allowing optimal transfer currents $I_0$ to flow through the respective primary transfer rollers.

Next, the optimal transfer voltages $V_1$ determined in the step S1 are applied to the corresponding primary transfer rollers 7Y, 7M, 7C, and 7K (step S2), and then constant voltage control is performed. Moreover, transfer currents $I_1$ flowing through the individual primary transfer rollers 7Y, 7M, 7C, and 7K immediately after the ATVC (herein, $I_1$ is nearly equal to $I_0$) are detected by the current detection section 80. The detected values of the transfer currents $I_1$ are then stored in a predetermined region of the storage section 30 (step S3).

Subsequently, in the image forming section 70, based on the inputted image data, toner images are formed on the photoreceptor drums 4Y, 4M, 4C, and 4K. The primary transfer rollers 7Y, 7M, 7C, and 7K are then brought into pressure contact with the photoreceptor drums 4Y, 4M, 4C, and 4K with the toner images formed thereon, respectively, for transfer of images onto the intermediate transfer belt 8 (step S4). After transfer of the image, the values $I_n$ of the transfer currents of the primary transfer rollers 7Y, 7M, 7C, and 7K after transfer are detected by the current detection section 80, and the results of detection is stored in a predetermined region of the storage section 30 (step S5). By execution of the job, the image transferred onto the intermediate transfer belt 8 is secondary transferred onto a sheet of paper in the image forming section 70 and then fixed. The sheet is then outputted to the exit tray 28.

Next, based on the transfer current values $I_n$ and $I_1$ of the primary transfer rollers 7Y, 7M, 7C, and 7Y which are stored in the storage section 30, the amount (ΔI) of change in transfer current of each of the primary transfer rollers 7Y, 7M, 7C, and 7K is calculated as $\Delta I = I_n - I_1$. Based on the calculated amount ΔI, the voltage to be applied to each of the primary transfer rollers 7Y, 7M, 7C, and 7K is determined (step S6). To be specific, the voltage to be applied to each of the primary transfer rollers 7Y, 7M, 7C, and 7K is determined as y calculated by assigning ΔI of the primary transfer rollers 7Y, 7M, 7C, and 7K into x of the function expressing the applied voltage control curves 31Y, 31M, 31C, or 31K of each color which are stored in the storage section 30, respectively. The determined voltage to be applied is then applied to the discharge electrode 71Y, 71M, 71C, and 71K of each color (step S7). The amount ΔI of current which is a part of the transfer current of each of the primary transfer rollers 7Y, 7M, 7C, and 7K is flown into the corresponding one of the discharge electrodes 71Y, 71M, 71C, and 71K or is canceled by minus charges generated by discharge. This allows only the previously determined current $I_1$ to be used for transfer of the next page.

Next, whether there are image data of the next page is determined based on job information of the job in execution (step S8). If there are image data of the next page (YES in the step S8), the process returns to the step S4 for transfer of an image of the next page, calculation of the increase ΔI in transfer current, and determination and application of the voltages applied to the discharge electrodes 71Y, 71M, 71C, and 71K based on ΔI. If it is determined that there are no image data of the next page (NO in the step S8), the applied voltage control process is terminated.

Figure 8:
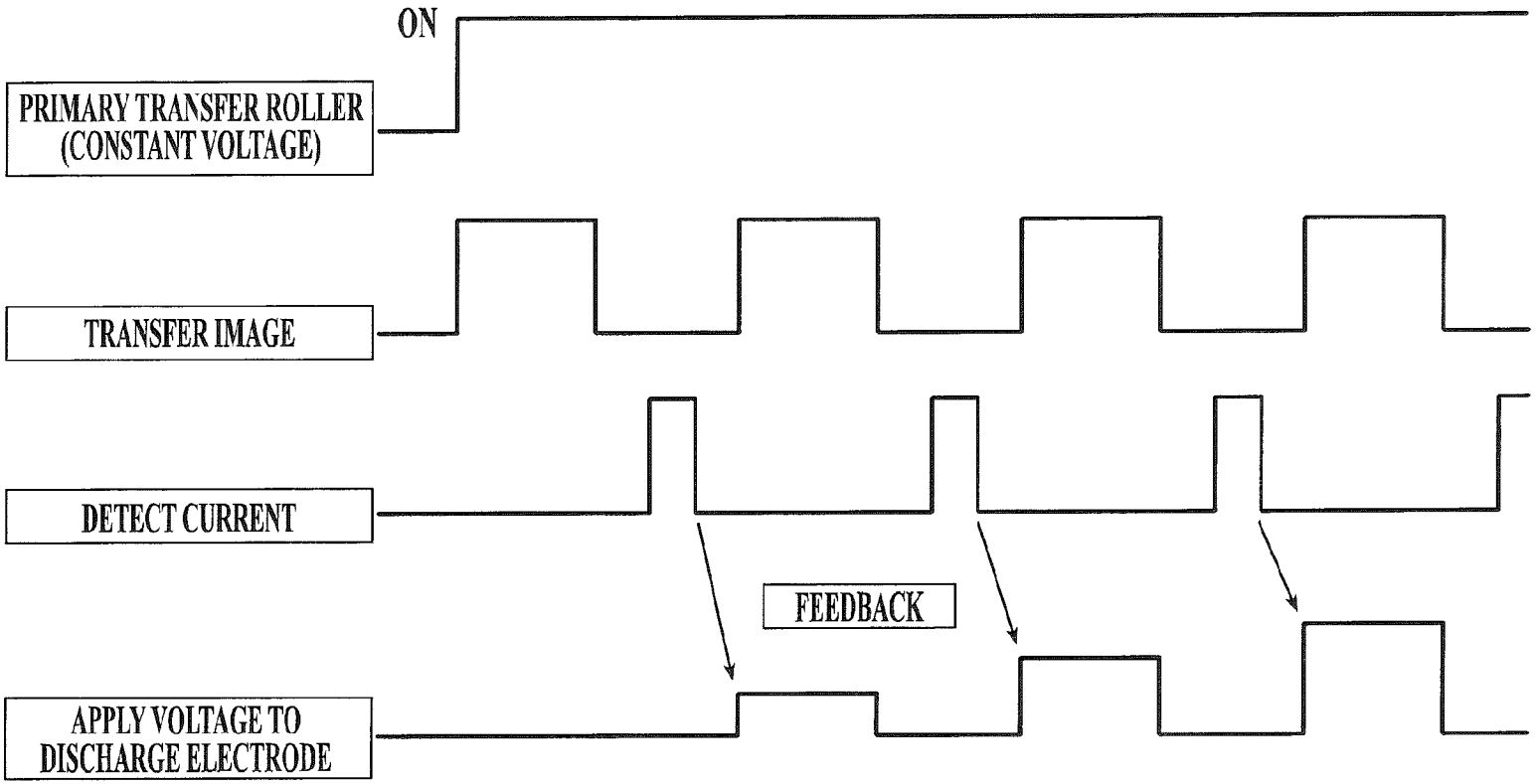
FIG. 8 is a timing diagram of a main step of the applied voltage control process of FIG. 7.

FIG. 8 shows a timing diagram of main steps of the aforementioned applied voltage control process.

First, when the job starts, the optimal transfer voltages $V_1$ determined by the ATVC are applied to the primary transfer rollers 7Y, 7M, 7C, and 7K, respectively. Each of the primary transfer rollers 7Y, 7M, 7C, and 7K is subjected to constant voltage (the optimal transfer voltage $V_1$) as shown in FIG. 8 until printing of all the pages included in the job is finished.

Moreover, the transfer currents $I_n$ are detected by the current detection section 80 between transfer of the image by the primary transfer rollers 7Y, 7M, 7C, and 7K and transfer of the next image. The detection results are fed back to determination of the voltages to be applied to the discharge electrodes 71Y, 71M, 71C, and 71K at the next image transfer.

Herein, to verify the effect of the aforementioned applied voltage control process, the following verification experiments and comparison experiments were carried out.

[Verification Experiment]

Figure 9:
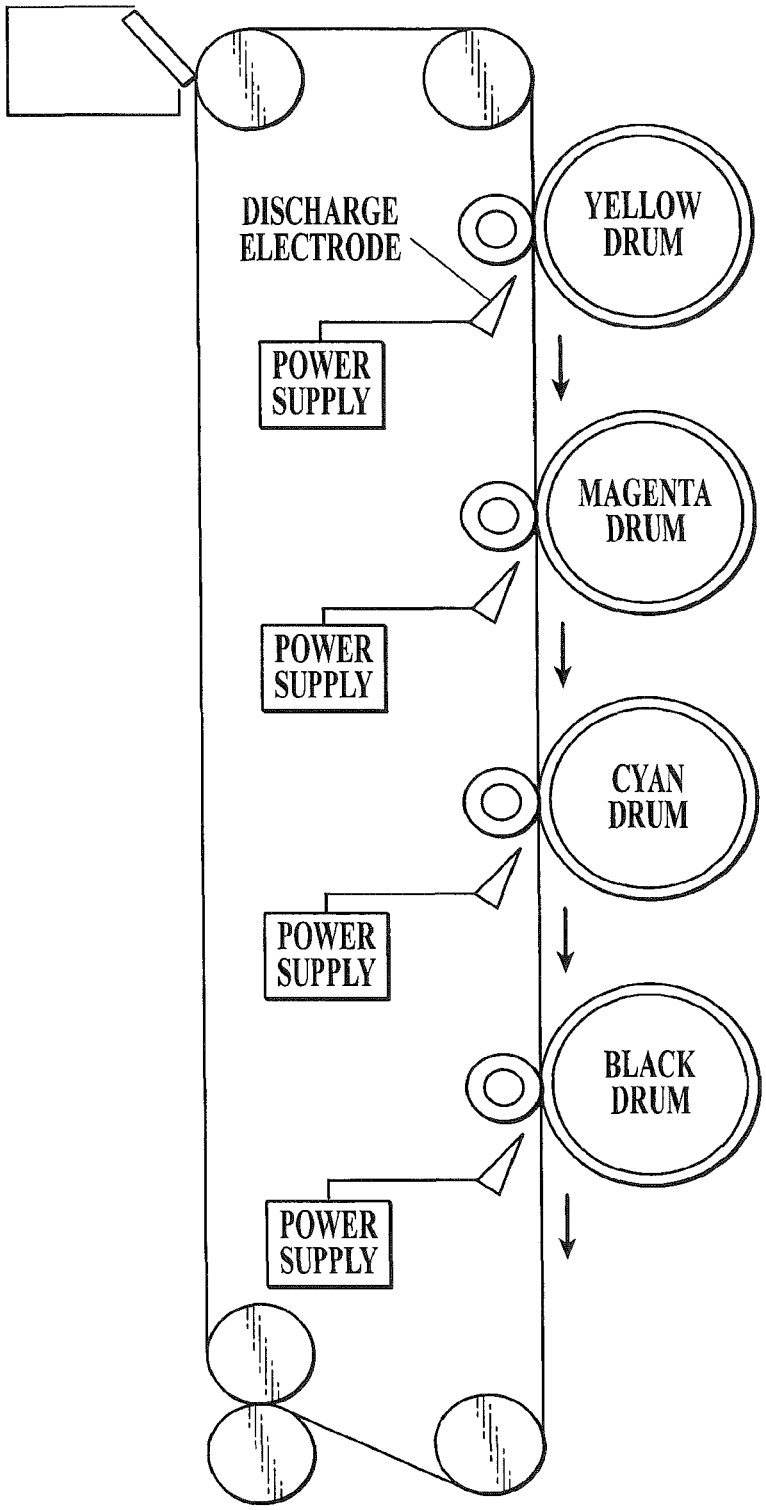
FIG. 9 is a view showing a configuration example of a main portion around a transfer section of an image forming apparatus used in verification experiments.

The verification experiments used an image forming apparatus having a configuration including a discharge electrode near the primary transfer roller of each color (see FIG. 9). Table 1 shows the specifications of the image forming apparatus. In the verification experiments, 1000 sheets were continuously printed with the aforementioned applied voltage control process, and the image density was measured for each certain number of prints. The measurement of the density used a reflection density meter (Spectolino by Gretag Macbeth). As the applied voltage control curves, the applied voltage control curves obtained by the pre-experiment (FIG. 10) were used.

TABLE 1

| | | |
|---|---|---|
| Apparatus | | Full color machine with intermediate transfer body |
| Process Speed | | 300 mm/sec |
| Intermediate Transfer Body | Material | Polyimide semi-conducting belt |
| | Profile | Thickness: 80 μm<br>Circumferential length: 861 mm<br>Width: 362 mm |
| | Resistivity | 10 to 11 LogΩ/ |
| Transfer Roller (Image Forming Roller) | Outer Diameter | Φ22 (core: Φ10) |
| | Material | Single layer of NBR ion conductive rubber sponge |
| | Hardness | 40° C. (Asker-C) |
| | Resistance | 2.0E+7Ω (NN environment, at 1 kV) |
| Electrode Power Supply | | AC: Vpp = 8.0 kV<br>DC: 0 to −3.0 kV |

Figure 11A:
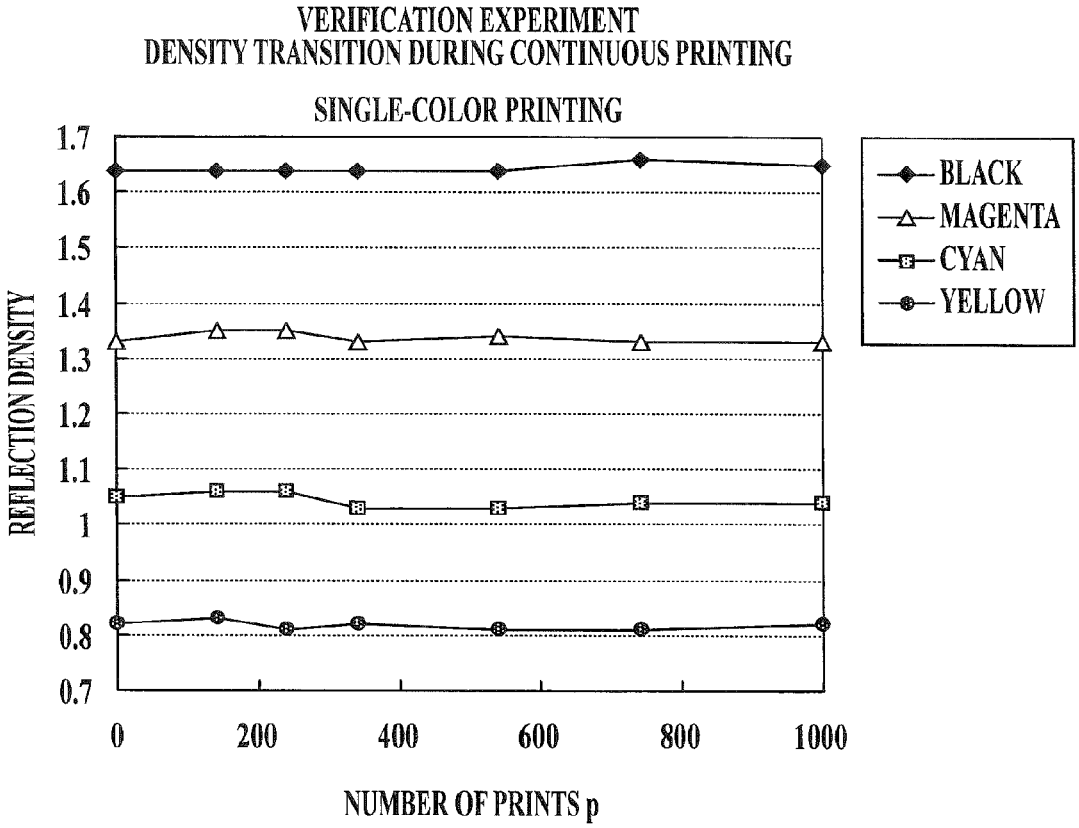
FIG. 11A is a diagram showing density transition during continuous printing of a single-color printed solid image in the verification experiments.
Figure 11B:
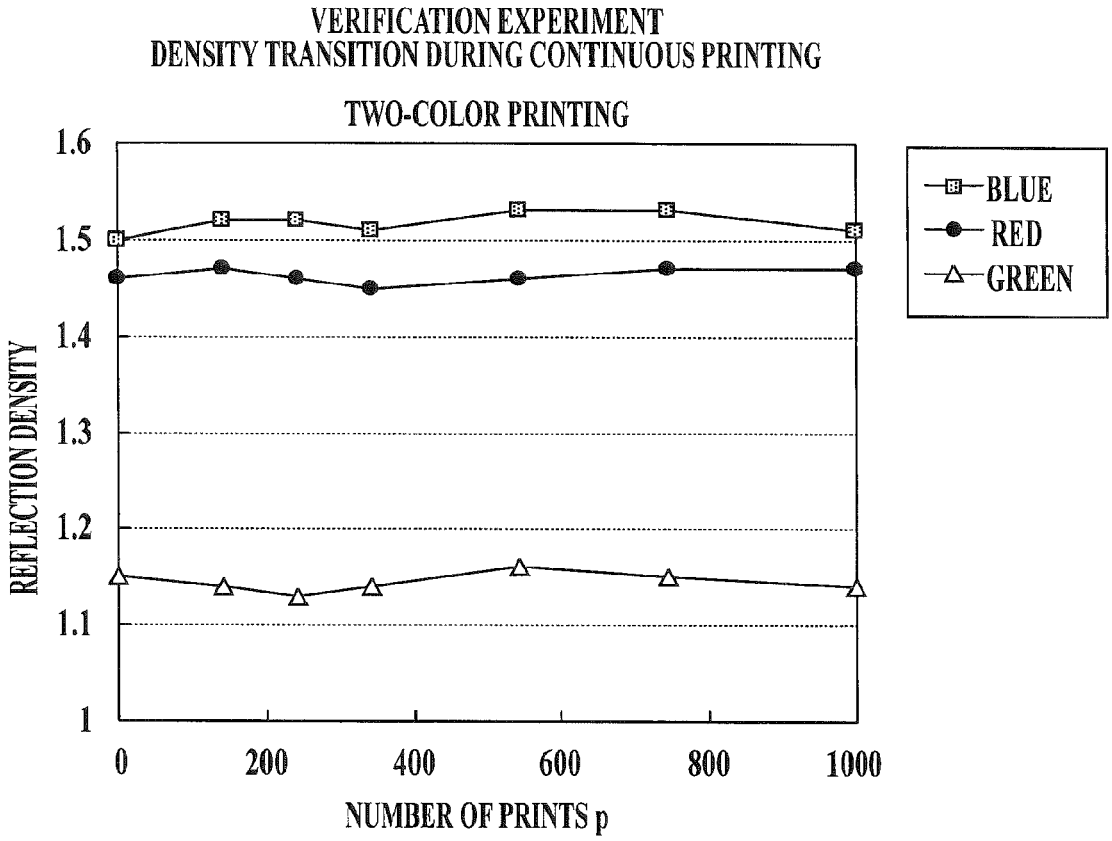
FIG. 11B is a diagram showing density transition during continuous printing of a two-color printed solid image in the verification experiments.

FIG. 11A shows density transition during continuous printing of 1000 sheets of each single-color printed solid image (yellow, magenta, cyan, or black image) under the aforementioned conditions. FIG. 11B shows density transition during continuous printing of 1000 sheets of each two-color printed solid image (red, green, or blue image) under the aforementioned conditions.

As shown in FIGS. 11A and 11B, in the verification experiments, there was not much changes in density with the increase in number of prints of any of the colors. The applied voltage control process detects transfer current between sheets and feeds back the detection result to determination of voltage to be applied to the discharge electrodes for adjusting the transfer current for the next image. The applied voltage control process can therefore address changing resistance of the transfer members due to increasing temperature within the apparatus. Accordingly, it could be verified that the applied voltage control process allowed transfer with substantially constant density without stopping even a job of continuous printing.

[Comparison Experiment]

Figure 12:
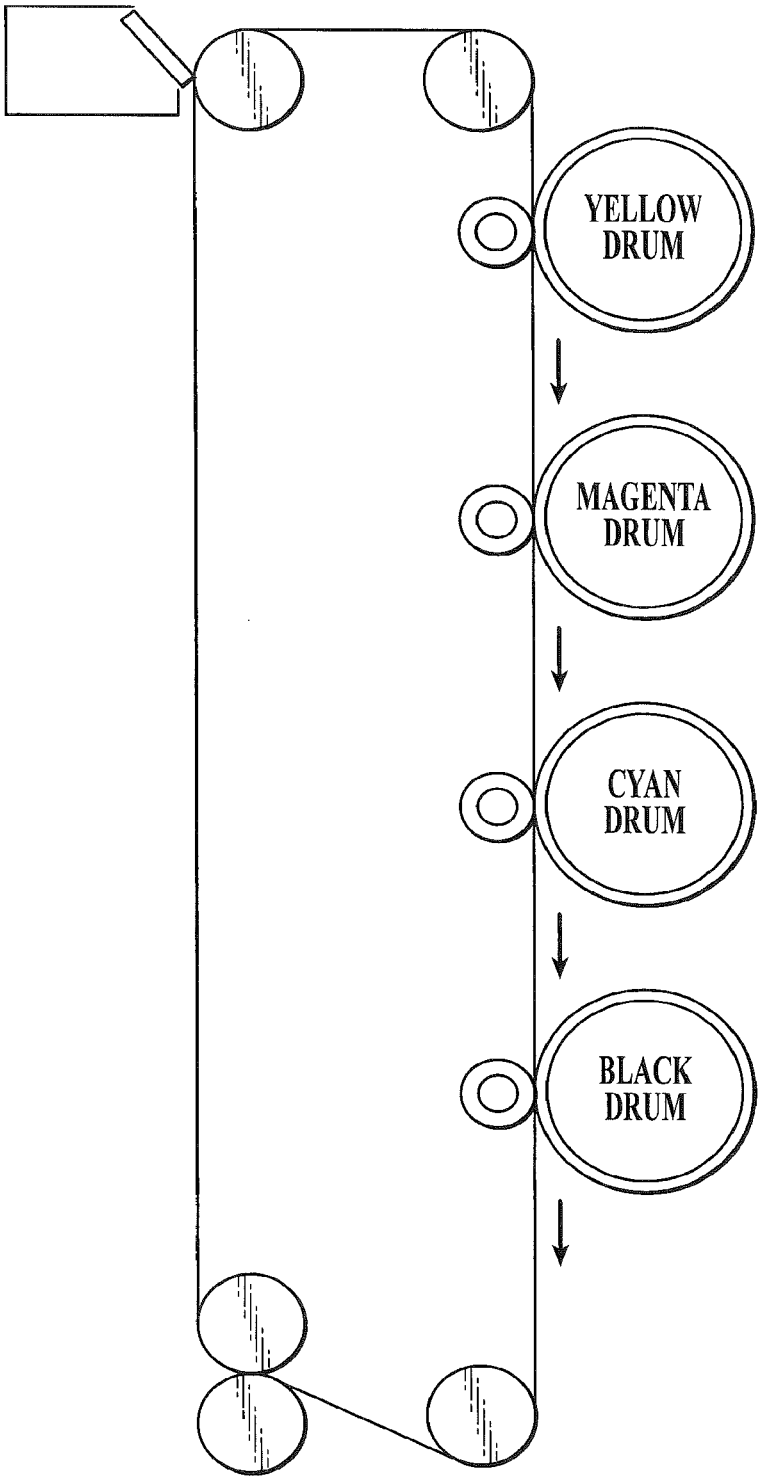
FIG. 12 is a view showing a configuration example of a main portion around a transfer section of an image forming apparatus used in comparison experiments.

The comparison experiments used an image forming apparatus having a configuration not including the discharge electrode near the primary transfer roller of each color (see FIG. 12). The image forming apparatus had the specifications shown in Table 1 (except the specifications of the electrode power supply). After the ATVC, 1000 sheets were continuously printed, and the image density was measured for each certain number of prints. The measurement of the density used a reflection density meter (Spectolino by Gretag Macbeth).

Figure 13A:
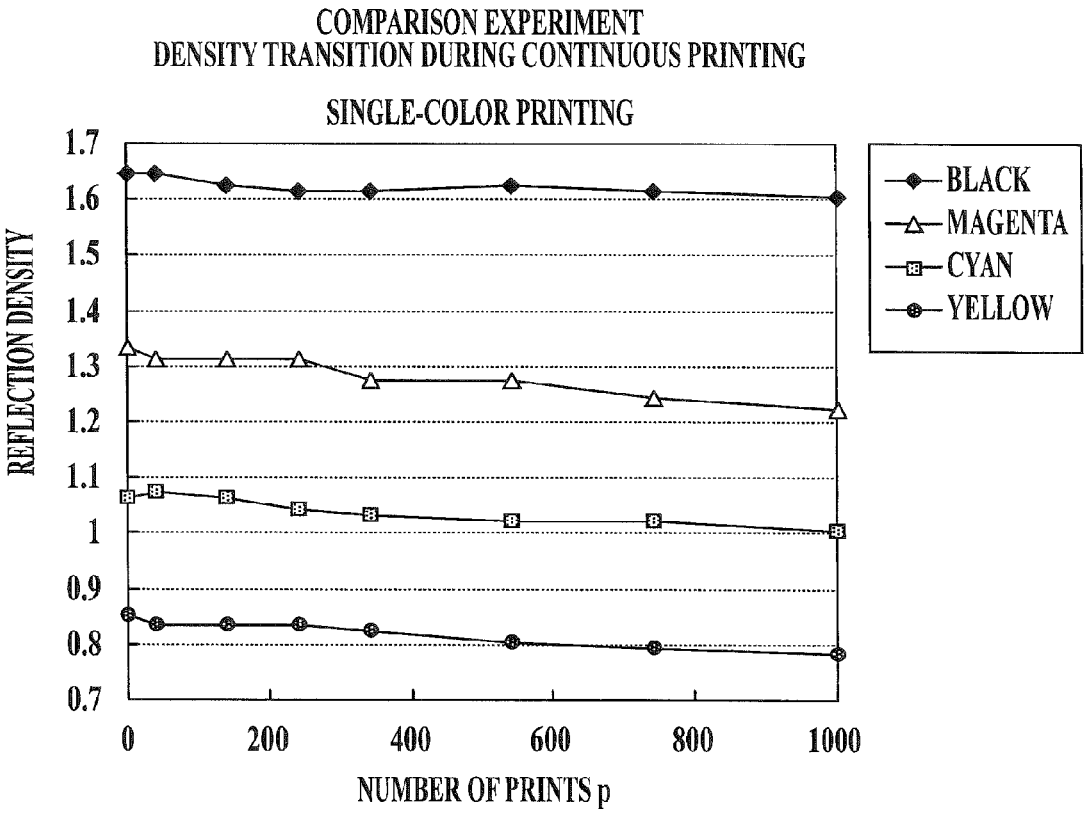
FIG. 13A is a diagram showing density transition during continuous printing of a single-color printed solid image in the comparison experiments.
Figure 13B:
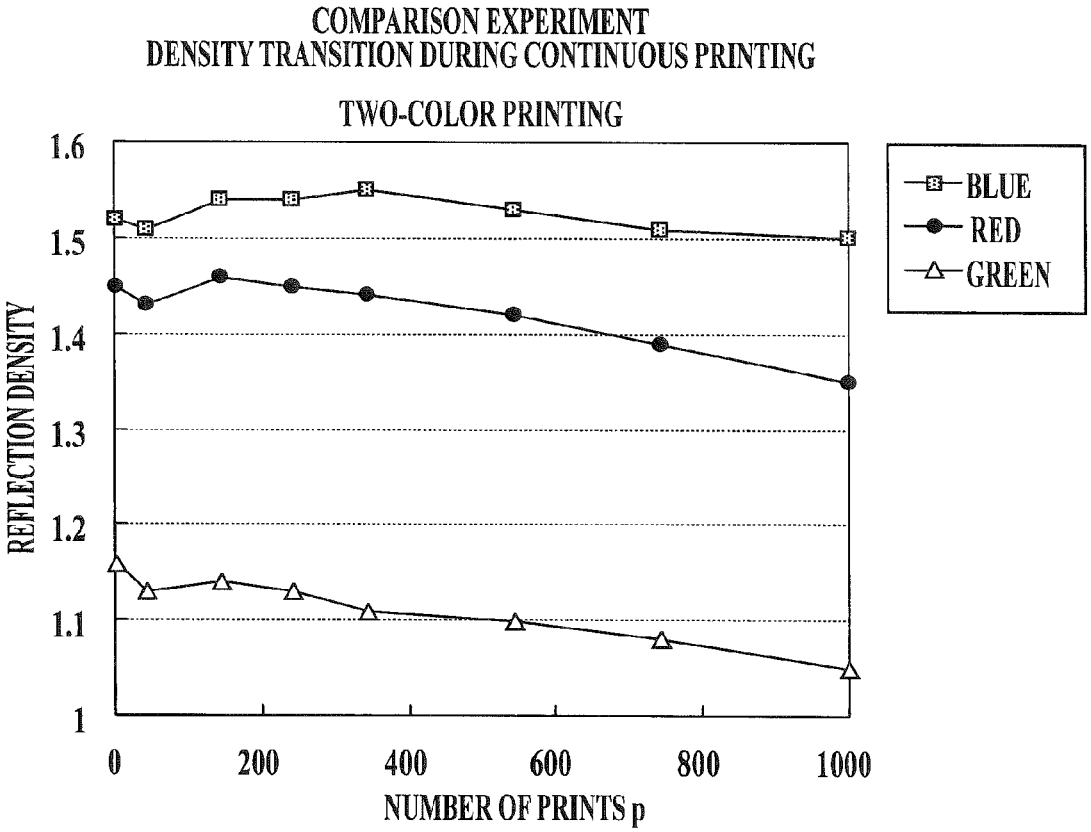
FIG. 13B is a view showing density transition during continuous printing of a two-color printed solid image in the comparison experiments.

FIG. 13A shows density transition during continuous printing of 1000 sheets of each single-color printed solid image under the aforementioned conditions. FIG. 13B shows density transition during continuous printing of 1000 sheets of each two-color printed solid image under the aforementioned conditions.

As shown in FIGS. 13A and 13B, the comparison experiment produced a result that the image density was reduced with an increase in number of prints for every color. This experiment performed the ATVC only at a rotation just before the start of printing and applied constant voltage from beginning to end during the continuous printing. The reduction in density is considered to be caused because, by change in resistance of the primary transfer rollers, the transfer current is deviated from the optimal value to change the transfer properties. In order to prevent the reduction in density, that is, the degradation of the transfer properties, it is necessary to perform the ATVC during the job, but will inevitably influence the productivity.

The aforementioned verification and comparison experiments verified that the application of voltage to the discharge electrodes by the applied voltage control process in the aforementioned embodiment can prevent degradation in transfer properties (change in density) without reducing the productivity by the ATVC carried out during the job.

In the description of the aforementioned embodiment, the transfer current $I_1$ of each primary transfer roller is detected immediately after the ATVC, and the transfer current $I_n$ of the same is detected between sheets. The voltage applied to each discharge electrode is determined based on the difference ΔI between the transfer currents $I_1$ and $I_n$. However, the parameter to determine the voltage to be applied to the discharge electrodes is not limited to these as long as the parameter can specify the change in transfer current due to the change in resistance changing by continuous constant voltage control.

For example, the parameters to determine the voltages to be applied to the discharge electrodes 71Y, 71M, 71C, and 71K may be the resistances of the primary transfer rollers 7Y, 7M, 7C, and 7K, respectively. The voltages to be applied to the discharge electrodes 71Y, 71M, 71C, and 71K may be determined based on the difference ΔR between a resistance value $R_1$ of each primary transfer roller 7Y, 7M, 7C, and 7K detected immediately after the ATVC and a resistance value $R_n$ of the primary transfer roller 7Y, 7M, 7C, and 7K detected between sheets. The resistance value of each of the primary transfer rollers 7Y, 7M, 7C, and 7K can be obtained by calculation using the Ohm's law based on the transfer current detected by the current detection section 80 and the optimal transfer voltage $V_1$. The image forming apparatus 1 may be provided with a resistance meter or the like instead of the current detection section 80 to directly detect the resistance values. In the case of performing the applied voltage control process based on ΔR, the pre-experiment is performed to obtain the relation between the voltage applied to each of the discharge electrodes 71Y, 71M, 71C, and 71K and the amount of current flown from the transfer current into the same is previously obtained by the pre-experiment and obtain the relation between the transfer current and resistance value of each primary transfer roller 7Y, 7M, 7C, and 7K when the optimal transfer voltage $V_1$ is applied to the same. Based on the above relations, the applied voltage control curves 31Y, 31M, 31C, and 31K are generated with the changes ΔR in resistance of the primary transfer rollers represented in the horizontal axes and are stored in the storage section 30.

Moreover, for example, the parameters to determine the voltages to be applied to the discharge electrodes may be the density of each color. The applied voltage control process is performed based on a difference ΔD between a density $D_1$ of each color detected just after the ATVC and a density $D_n$ of the color detected between sheets. The density of each color can be detected by forming an image patch for density measurement of each color on the intermediate transfer belt 8 between sheets and providing a density sensor as the detector in the downstream of the primary transfer position of each color to read the image patch with the density sensor of the color. In the case of performing the applied voltage control process based on ΔD, the pre-experiment is performed to previously obtain the relation between the voltage applied to each of the discharge electrodes 71Y, 71M, 71C, and 71K and the amount of current flown into the same and to obtain the relation between the transfer current of each primary transfer roller 7Y, 7M, 7C, and 7K and the sensor output value obtained by reading the image patch with the density sensor when the optimal transfer voltage $V_1$ is applied. Based on the above obtained relations, each of the applied voltage control curves 31Y, 31M, 31C, and 31K is generated with the horizontal axis representing the change ΔD in the value outputted from the density sensor reading the image patch and stored in the storage section 30.

As described above, even if the parameter to determine the voltage applied to each discharge electrode is the resistance of the corresponding primary transfer roller or the output value (density) of the density sensor of each color, it is possible to provide the same effects as those in the case where the parameter is current.

As described above, the image forming apparatus 1 performing constant-voltage control of the transfer bias includes: the discharge electrodes 71Y, 71M, 71C, and 71K configured to take part of the transfer currents of the primary transfer rollers 7Y, 7M, 7C, and 7K, respectively; and the current detection section 80 configured to detect the amounts of transfer currents of the primary transfer rollers 7Y, 7M, 7C, and 7K. The controller 10 specifies the increase in current since just after the ATVC of the transfer current of each primary transfer roller based on the amount of change in transfer current of each primary transfer roller 7Y, 7M, 7C, and 7K detected by the current detection section 80 between after image transfer onto the intermediate transfer belt 8 and immediately after the ATVC and then determines voltage necessary for the corresponding discharge electrode 71Y, 71M, 71C, and 71K to take the same amount of current as the increase in transfer current. The controller 10 then applies the determined voltage to the corresponding discharge electrode.

Accordingly, the change in transfer current of each transfer member can be reduced without frequently performing the ATVC in the case where the transfer members are constant voltage controlled. It is therefore possible to prevent change in transfer properties due to the change in resistance of the transfer members without reducing the productivity.

The description of the aforementioned embodiment shows a preferred example of the image forming apparatus according to the present invention, and the present invention is not limited to the above embodiment.

In the description of the above embodiment, for example, the present invention is applied to the image forming apparatus configured to transfer a toner image formed on the photoreceptor drum onto the intermediate transfer belt. However, the present invention can be similarly applied to the image forming apparatus configured to directly transfer the toner image formed on the photoreceptor drum to a transfer material such as paper.

Moreover, the controller 10 may be configured not to apply voltage to each discharge electrode when the amount of change in the parameter value between after image transfer and immediately after the ATVC does not exceed a previously determined value. To be specific, in the step S6 of the applied voltage control process, if ΔI (ΔR when the parameter is the resistance, and ΔD when the parameter is the density of each color) of the primary roller for any one of colors does not exceed a previously determined value, the controller 10 may be configured to determine the voltage to be applied to the discharge electrode of the color to be 0 and not apply voltage to the discharge electrode of the color in the step 7. This can prevent needless application of voltage to each discharge electrode and prevent needless wear of the discharge electrodes.

Moreover, in the example disclosed in the above description, the computer-readable medium for the programs according to the present invention is a ROM, a non-volatile memory, a hard disk, or the like but is not limited to these examples. As another (non-transitory) computer-readable medium, a portable recording medium such as a CD-ROM can be applied. Moreover, as a medium providing data of the programs according to the present invention through a communication line, a carrier wave can be applied.

The other detailed configurations and operations of the image forming apparatus 1 can be properly changed without departing from the scope of the present invention.

The entire disclosure of Japanese Patent Application No. 2011-143651 filed on Jun. 29, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a transfer member to transfer a toner image formed on a photoreceptor to an intermediate transfer body or a transfer material;

a controller to determine voltage to be applied to the transfer member so that transfer current of the transfer member has a previously determined value and to perform constant voltage control so that the voltage to be applied to the transfer member becomes the determined voltage;

a discharge electrode provided near a transfer nip portion of the transfer member to take a part of the transfer current flowing through the transfer member according to the applied voltage;

a detector to detect a parameter value of a predetermined parameter by which the transfer current of the transfer member that changes by continuous operation of the constant voltage control can be specified; and a storage section to store the parameter value detected by the detector immediately after the voltage to be applied to the transfer member is determined, wherein based on an amount of change between the parameter value detected by the detector after transfer by the transfer member and the parameter value stored in the storage section, the controller determines voltage necessary for the discharge electrode to take the same amount of current as an increase in transfer current of the transfer member from the previously determined transfer current and applies the determined voltage to the discharge electrode.

2. The image forming apparatus according to claim 1, wherein the controller does not apply voltage to the discharge electrode if the amount of change between the parameter value detected by the detector after the transfer and the parameter value stored in the storage section does not exceed a previously determined value.

3. The image forming apparatus according to claim 1, wherein the predetermined parameter includes transfer current of the transfer member.

4. The image forming apparatus according to claim 1, wherein the predetermined parameter includes electric resistance of the transfer member.

5. The image forming apparatus according to claim 1, wherein the detector includes a density sensor for reading an image patch for density measurement which is formed on the photoreceptor and transferred to the intermediate transfer body, and the predetermined parameter includes an output of the density sensor.

6. A method of controlling transfer current in an image forming apparatus, the method comprising the steps of:

determining voltage to be applied to a transfer member so that transfer current of the transfer member has a previously determined value, the transfer member being configured to transfer a toner image formed on a photoreceptor to an intermediate transfer body or a transfer material, and performing constant voltage control so that the voltage to be applied to the transfer member becomes the determined voltage;

detecting a parameter value of a predetermined parameter by which the transfer current of the transfer member that changes by continuous operation of the constant voltage control can be specified;

causing a storage section to store the parameter value detected immediately after the voltage to be applied to the transfer member is determined;

based on an amount of change between the parameter value detected after transfer by the transfer member and the parameter value stored in the storage section, determining voltage necessary for a discharge electrode provided near a transfer nip portion of the transfer member to take the same amount of current as an increase in transfer current of the transfer member from the previously determined transfer current and applying the determined voltage to the discharge electrode; and causing the discharge electrode to take a part of the transfer current flowing through the transfer member according to the applied voltage.

7. The method according to claim 6, wherein the controller does not apply voltage to the discharge electrode if the amount of change between the parameter value detected by the detector after the transfer and the parameter value stored in the storage section does not exceed a previously determined value.

8. The method according to claim 6, wherein the predetermined parameter includes transfer current of the transfer member.

9. The method according to claim 6, wherein the predetermined parameter includes electric resistance of the transfer member.

10. The method according to claim 6, wherein the predetermined parameter includes an output value of a density sensor for reading an image patch for density measurement which is formed on the photoreceptor and transferred to the intermediate transfer body.

* * * * *